US006146209A

United States Patent [19]

Francis

[11] Patent Number: 6,146,209

[45] Date of Patent: Nov. 14, 2000

[54] SURFACE MOUNTABLE ELECTRICAL CONNECTOR SYSTEM

[75] Inventor: Dexter W. Francis, Salt Lake City, Utah

[73] Assignee: 3COM Corporation, Santa Clara, Calif.

[21] Appl. No.: 09/417,577

[22] Filed: Oct. 14, 1999

Related U.S. Application Data

[63] Continuation of application No. 08/906,023, Aug. 5, 1997, Pat. No. 6,012,953.

[51] Int. Cl.[7] ..... H01R 24/00

[52] U.S. Cl. ..... 439/676; 439/344; 439/76.1; 361/686

[58] Field of Search ..... 439/676, 76.1, 439/344, 946, 946.2, 329, 928.1, 638; 361/686

[56] References Cited

U.S. PATENT DOCUMENTS

| | | | |
|---|---|---|---|
| 4,497,526 | 2/1985 | Myers | 339/17 LC |
| 4,767,355 | 8/1988 | Phillipson et al. | 439/676 |
| 4,875,872 | 10/1989 | Tanaka | 439/344 |
| 4,937,464 | 6/1990 | Nanba et al. | 439/344 |
| 5,035,641 | 7/1991 | Van-Santbrink et al. | 439/329 |
| 5,118,311 | 6/1992 | Margini | 439/676 |
| 5,310,360 | 5/1994 | Peterson | 439/571 |
| 5,336,099 | 8/1994 | Aldous et al. | 439/131 |
| 5,364,294 | 11/1994 | Hatch et al. | 439/676 |
| 5,403,207 | 4/1995 | Briones | 439/620 |
| 5,425,660 | 6/1995 | Weikle | 439/676 |
| 5,429,522 | 7/1995 | Noschese et al. | 439/133 |
| 5,431,586 | 7/1995 | Klas et al. | 439/676 |
| 5,457,601 | 10/1995 | Georgopulos et al. | 361/686 |
| 5,478,261 | 12/1995 | Bogese, II | 439/676 |
| 5,503,572 | 4/1996 | White et al. | 439/676 |
| 5,509,811 | 4/1996 | Homic | 439/55 |
| 5,547,401 | 8/1996 | Aldous et al. | 439/676 |
| 5,580,274 | 12/1996 | Tsair | 439/571 |
| 5,642,259 | 6/1997 | Ma | 361/686 |
| 5,773,332 | 6/1998 | Glad | 439/344 |
| 5,791,943 | 8/1998 | Lo et al. | 439/676 |
| 5,984,731 | 11/1999 | Laity | 439/676 |

*Primary Examiner*—Paula Bradley
*Assistant Examiner*—Tho D. Ta
*Attorney, Agent, or Firm*—Workman, Nydegger & Seeley

[57] ABSTRACT

A connector platform includes a base having a first end and opposing second end. A retention wall upwardly projects from the first end of the base and has a plurality of slots longitudinally extending therein. A plurality of resiliently flexible conducting wires each have a first end projecting from the first end of the base and a securing portion extending from the first end of the base to the second end thereof. Each conducting wire further includes an engaging portion upwardly projecting from the second end of the base to the retention wall. A second end of each conducting wire is freely disposed within a corresponding slot of the retention wall. The platform is selectively enclosed within the housing of an electrical apparatus. The housing defines an opening which provides access to the platform. The opening and platform combine to form a receptacle configured to receive a standard RJ-type plug.

58 Claims, 3 Drawing Sheets

SURFACE MOUNTABLE ELECTRICAL CONNECTOR SYSTEM

CROSS-REFERENCE TO RELATED APPLICATIONS

This is a continuing application of U.S. Ser. No. 08/906,023 which was filed on Aug. 5, 1997, U.S. Pat. No. 6,012,953 and is hereby incorporated by reference in its entirety.

BACKGROUND OF THE INVENTION

1. Field of the Invention

The present invention relates to telephone and data communication connectors and, more specifically to connectors for electrically coupling PC boards to communication lines.

2. Description of Related Art

Electrical connectors such as RJ-type connectors provide an easy and quick method for coupling a data or telephone line, to a telephone, modem, or computer. Due to the simplicity of the connection and the corresponding standardized structure, RJ-type connections are used extensively in the telecommunication and computer industries. RJ-type connectors include a plug, or contact block and a receptacle or socket. The plug is attached to the end of an electrical cable or wire. The RJ plug is selectively received within a receptacle or socket which is secured to the hardware.

An RJ plug or contact block comprises a small block housing a plurality of distinct metal contacts which are discretely attached to different wires. A plurality of thin slots extend from the end of the block to each of the contacts. Mounted on the outside of the block is a flexible retention arm.

In complement, the receptacle comprises an integral housing having a socket formed therein. The housing is electrically coupled to the desired hardware. The socket has a plurality of flexible wires which are oriented to be received within corresponding slots of the RJ plug when the RJ plug is slid into the socket. The wires within the housing press against corresponding contacts on the RJ plug to complete electrical connection between the RJ plug and socket.

Formed on the roof of the socket is a recess. As the RJ plug is slid into the socket, the flexible retention arm on the RJ plug is initially compressed. The flexible retention arm is biased upward to engage the recess. Engagement between the retention arm and the recess locks the RJ plug within the socket. By later selectively compressing the flexible retention arm, the plug is released from the recess and the RJ plug can be easily removed from the socket.

Although used extensively, there are several shortcomings associated with conventional receptacles used with RJ plugs to make connectors. For example, the various electronic industries are continually struggling to miniaturize hardware. Increasingly, the receptacle housing is one of the larger internal components of the improved, slimmer and trimmer hardware. This is especially true where the receptacle is being mounted on a circuit board. Accordingly, the size of the receptacle is often the limiting factor in the size or thickness of a structure.

The relatively large size of the receptacle can also take up critical space on circuit boards which, under conventional standards, may be limited as to size. Furthermore, the large size of the receptacle can make it difficult to pick and place the receptacle on a circuit board using conventional equipment. This is because most equipment for picking and placing on a circuit board are designed for handling only very small components. As a result, the receptacle may have to be positioned manually.

An additional problem with conventional receptacles for RJ connectors is that the receptacle functions as both the structure for making the electrical contact and for mechanically securing the RJ plug to the hardware. It is a common occurrence that the wire attached to the RJ connector is pulled or tripped over, producing significant stress on the receptacle housing. To prevent the receptacle housing from breaking and to prevent the receptacle from being pulled out or displaced within the hardware, thereby severing the electrical connection, the receptacle must be structurally reinforced. In turn, this structural reinforcing increases the size of the receptacle, thereby further complicating the problems discussed above.

OBJECTS AND BRIEF SUMMARY OF THE INVENTION

Accordingly, it is an object of the present invention to provide improved apparatus for electrically coupling plugs to hardware.

Another object of the present invention is to provide improved apparatus for connectors where the receptacle is smaller than conventional receptacles.

Yet another object of the present invention is to provide improved connectors where the connector has a shorter height than conventional receptacles.

Yet another object of the present invention is to provide improved connectors where the connectors use less surface area on a circuit board than conventional receptacles.

Finally, it is an object of the present invention to provide improved connectors which reduce the mechanical stress placed on the electrical connection.

To achieve the foregoing objects, and in accordance with the invention as embodied and broadly described herein in the preferred embodiment, a surface mountable connector is provided. The plug includes a block having a first end and an opposing second end. A retention wall projects upwardly from the first end of the base and has a plurality of slots longitudinally extending therethrough. A plurality of resiliently flexible conducting wires each have a first end projecting from the first end of the base and a securing portion extending from the first end of the base to the second end thereof. Each conducting wire further includes an engaging portion upwardly projecting from the second end of the base to the retention wall. A second end of each conducting wire is freely disposed within a corresponding slot in the retention wall.

During use, a typical receptacle is attached to an electronic component. For example, the receptacle can be surface mounted on a circuit board with the first end of each of the conducting wires soldered or otherwise connected to leads on the circuit board. The receptacle and circuit board are next enclosed within the housing of the electrical device, such as a telephone, computer, or modem. The housing of the electrical device must include an opening to facilitate access by a plug to the receptacle. The opening is defined by a perimeter wall that is configured substantially complementary to the plug. When the plug passes through the opening and engages the receptacle, the discrete contacts on the receptacle are biased against a corresponding conducting wire on the plug. The receptacle captures the biased retaining arm on the plug. The plug and receptacle combine to form the connector.

In contradistinction, the inventive connector utilizes a conventional plug, but removes some of the receptacle structures to reduce the overall size of the connector. The removed structures are replaced by structures incorporated in the housing of the electrical device itself. Some of the receptacle functions in the inventive connector are incorporated into the opening in the housing of the device. When the plug passes through the opening, contact wires in a contact platform make electrical connection with corresponding wires on the plug. The walls of the opening itself have ridges designed to capture and engage the biased retaining arm of the plug. Thus, the plug and the walls of the opening in the housing of the device form the physical connection without the need for a separate receptacle. The contact platform facilitates the electrical connection. Only the contact platform is attached to the PC board. The contact platform, housing opening and plug make up the components of the inventive connector system.

The inventive connector system including the uniquely configured housing provide several advantages over conventional connectors. For example, since the inventive connector utilizes an opening in the housing, the portions of the receptacle such as the walls and roof are not required. The connector system may now have a smaller height, width, and surface area compared to conventional receptacles. This allows for further miniaturizing of structures in which any type of connection is desired. By minimizing the size of the receptacle, the connector can be easily surface mounted on a circuit board using conventional pick and place equipment. Finally, since the receptacle is limited solely to the function of providing electrical contact and does not perform the function mechanical engagement with the plug, the stresses produced are shifted to the device housing.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
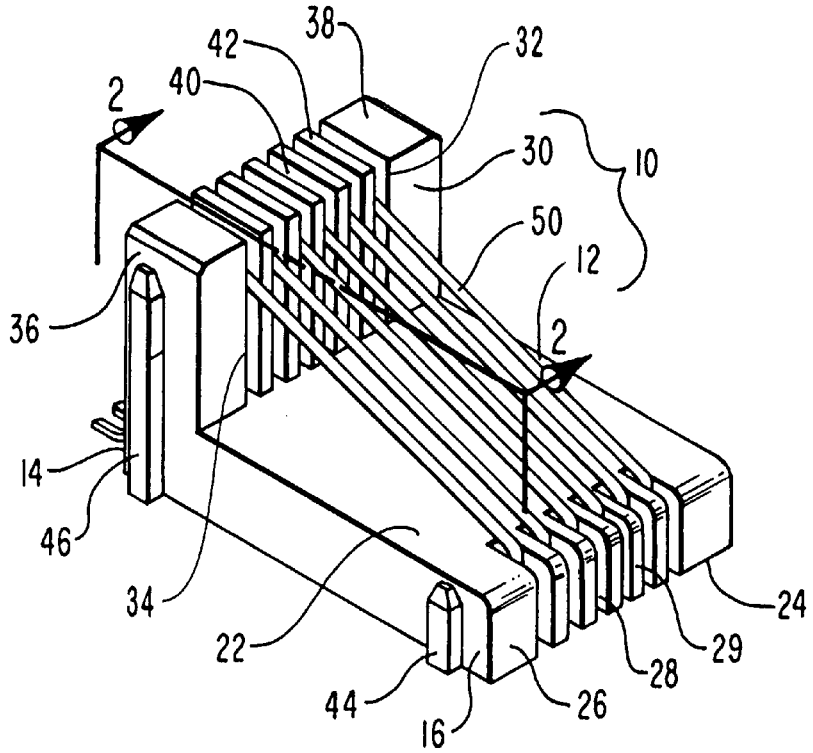
FIG. 1 is a perspective view of one embodiment of the contact platform.

Depicted in FIG. 1 is one embodiment of a platform 10 incorporating features of the present invention. As depicted therein, platform 10 comprises a substantially rectangular base 12 having a first end 14, an opposing second end 16. Second end 16 of base 12 terminates at an end face 26. A plurality of slots 28 are recessed within end face 26 and define a plurality of spaced apart insulating ribs 29. Base 12 further includes a top surface 22 and an opposing bottom surface 24.

Upstanding from first end 14 on top surface 22 of base 12 is a substantially rectangular retention wall 30. Retention wall 30 has opposing sidewalls 32 and 34 which extend from base 12 to a top end 36. Top end 36 of retention wall 30 terminates at a top face 38. A plurality of parallel slots 40 extend through retention wall 30 from top face 38 to base 12. Slots 40 define a plurality of parallel, spaced apart separating ribs 42.

Figure 2:
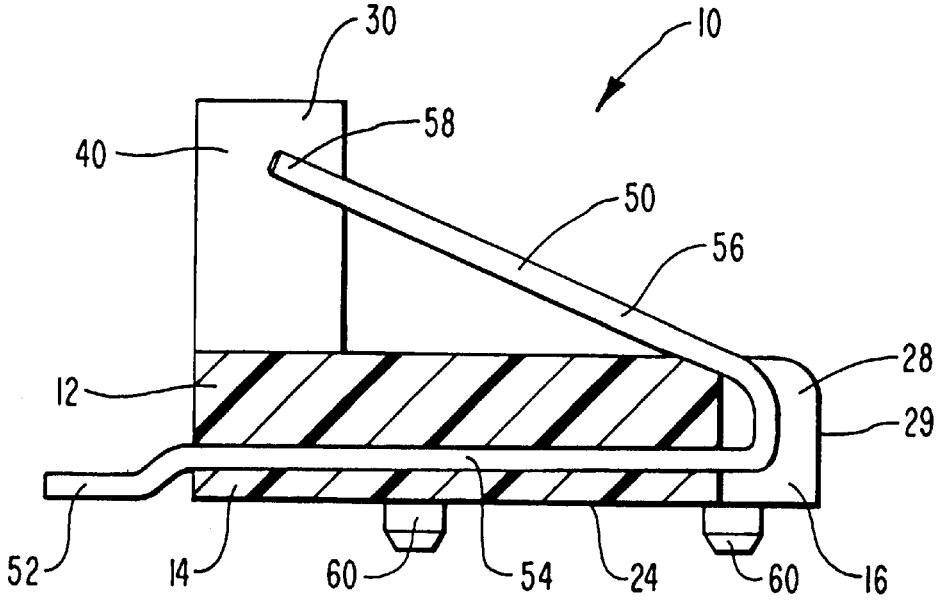
FIG. 2 is a cross-sectional side view of the platform shown in FIG. 1 taken along section lines 2—2.

An alignment ridge 44 projects from second end 16 of base 12. Alignment ridges 44 project in substantial parallel alignment with retention wall 30. Similarly, an alignment ridge 46 projects from first end 14 of base 12. Alignment ridges 46 also upwardly extend so as to likewise project from retention wall 30. Alignment ridges 46 are also oriented substantially parallel with retention wall 30. As depicted in FIG. 2, a pair of alignment pegs 60 project from bottom surface 24 of base 12.

Platform 10 further includes a plurality of discrete conducting wires 50. As depicted in FIG. 2, each conducting wire 50 includes a first end 52 freely projecting from first end 14 of base 12. An adjacent securing portion 54 of conducting wire 50 extends from first end 14 of base 12 to second end 16 thereof. Specifically, securing portion 54 terminates within a corresponding slot 28 positioned at second end 16 of base 12. Conducting wire 50 further includes an engaging portion 56 extending from second end 16 of base 12 back to retention wall 30. Conducting wire 50 terminates at a second end 58 that is freely disposed within a corresponding slot 40 of retention wall 30. Engaging portion 56 of conducting wire 50 projects at an upward angle such that second end 58 is elevated above base 12.

In the described configuration, insulating ribs 29 keep the plurality of conducting wires 50 separated to prevent accidental shorting therebetween. Separating ribs 42 perform a similar function of keeping second end 58 of each conducting wire 50 separated and insulated. As discussed later, separating ribs 42 also act as guides during movement of second end 58 of each conducting wire 50.

Base 12 and retention wall 30 are preferably integrally molded from an insulating material, such as polycarbonate plastic, using conventional injection molding processes. Securing portion 54 of conducting wires 50 can be enclosed within base 12 during the molding process. Alternatively, small passageways can be longitudinally formed through base 12. Securing portion 54 can then be slid within a corresponding passageway and secured therein, such as with an adhesive.

Each conducting wire 50 is preferably formed of a resiliently flexible metal such as spring steel. Accordingly, as a downward force is applied to engaging portion 56, engaging portion 56 produces a biasing force back toward its original position.

Platform 10 is used for electronic coupling with a plug, such as an RJ-type plug. As used in the specification and appended claims, the term "plug" is intended to include all types and styles of connectors including RJ-type and other connectors for physical electrical connection of communication devices. By way of example and not by limitation, various types of RJ connectors which could be used for coupling with platform 10 include the "RJ-11" and "RJ-45."

Platform 10, as depicted in FIGS. 1 and 2, is merely one embodiment of the invention. Platform 10 can of course vary to accommodate different types of RJ connectors. Different RJ connectors may require platform 10 to have a different number, sizing, and spacing of conducting wires 50 along with other modifications. The necessary modifications to platform 10 to enable coupling to different connectors would be known to those skilled in the art based on the disclosure herein.

Platform 10 can be used with any electrical equipment in which it is desirable to couple an RJ connector. By way of example and not limitation, conventional types of equipment which can use platform 10 include telephones, answering machines, personal computers, network systems, and modems.

Figure 3:
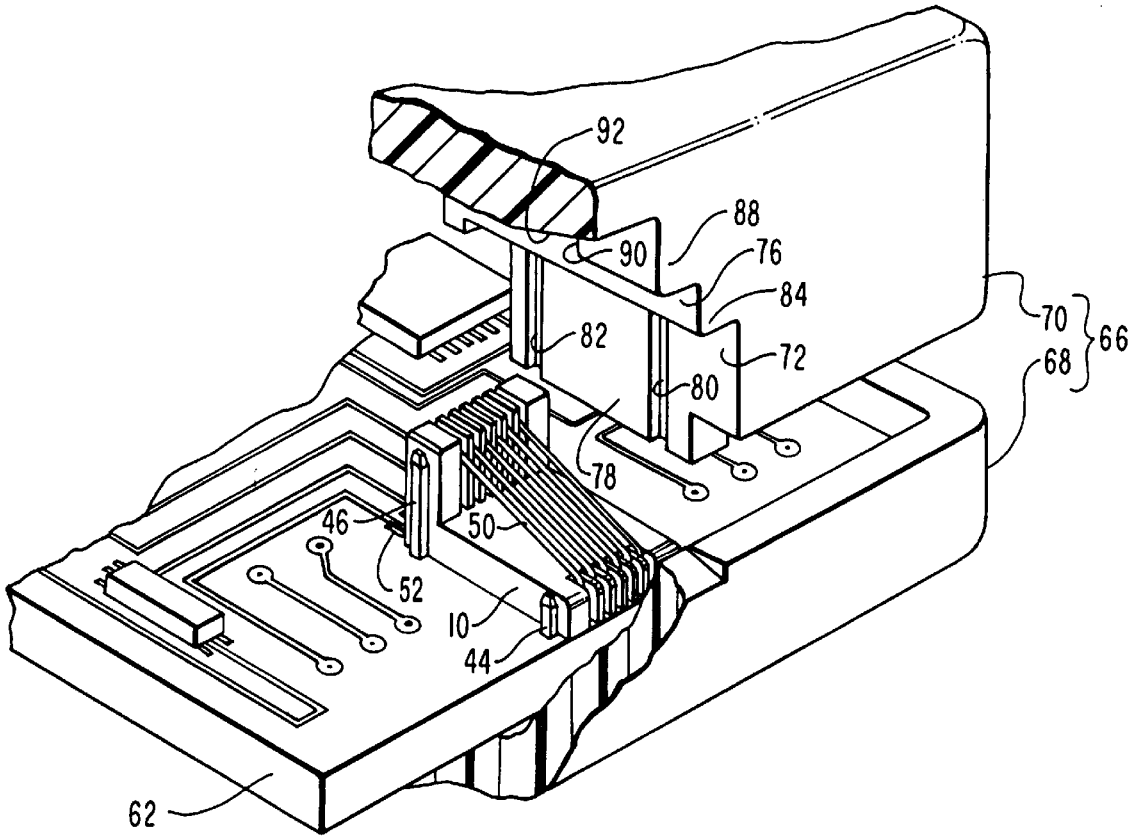
FIG. 3 is a perspective view of the platform shown in FIG. 1 mounted on a circuit board and enclosed within a housing.
Figure 4:
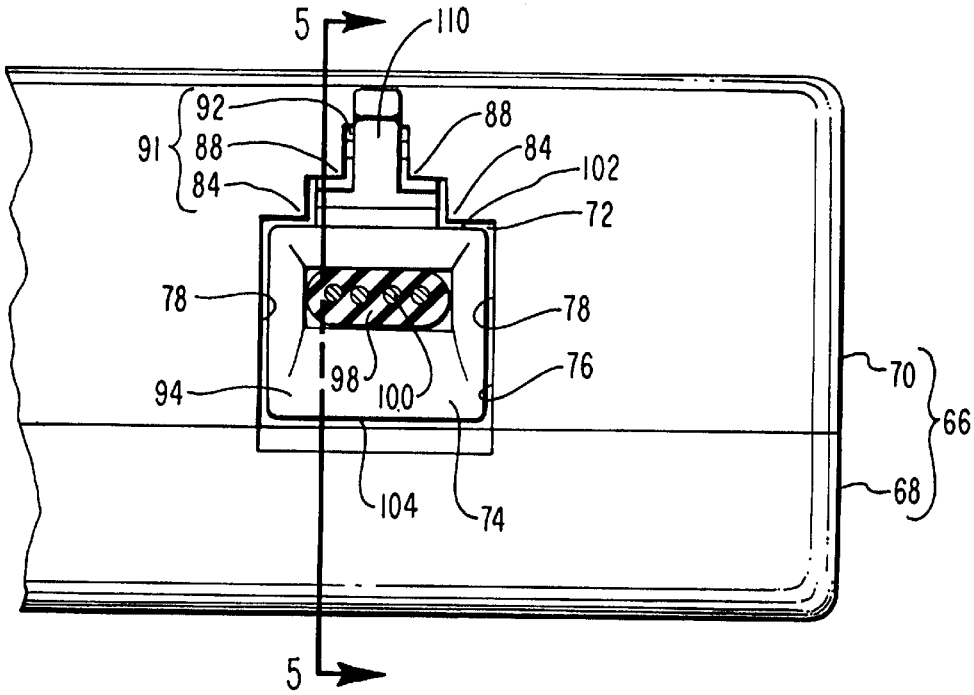
FIG. 4 is an elevated end view of an opening in the housing shown in FIG. 3 with an RJ plug received therein.
Figure 5:
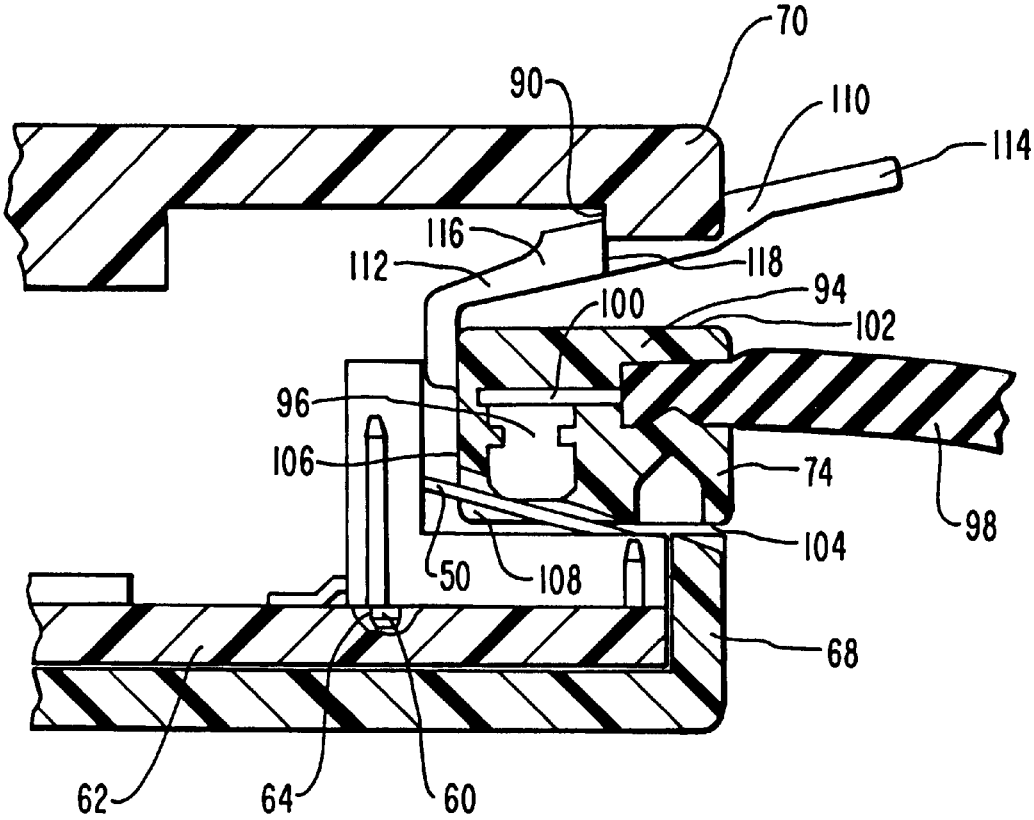
FIG. 5 is a cross-sectional side view of the components making the connector received within the opening of the housing shown in FIG. 4 taken along section lines 5—5.

By way of example as to how platform 10 is assembled with an electrical apparatus, depicted in FIGS. 3–4 platform 10 is surface mounted onto a circuit board 62. As depicted in FIG. 5, circuit board 62 includes apertures 64 which are configured to receive a corresponding alignment pin 60 so that platform 10 is properly positioned on circuit board 62. Returning to FIG. 3, in this position, first end 52 of each conducting wire 50 is soldered or otherwise connected to an appropriate lead on circuit board 62.

With platform 10 electrically coupled with circuit board 62, circuit board 62 and platform 10 are substantially enclosed within a housing 66. Housing 66 which, for example, could comprise the outside housing of a telephone, personal computer or other device, is depicted as comprising a base cover 68 and a top cover 70. Circuit board 62 and platform 10 are sandwiched between top cover 70 and base cover 68.

As depicted in FIGS. 3–4, the combined top cover 70 and base cover 68 form an opening 72 extending from the exterior to platform 10. Opening 72 enables a plug 74 to selectively attach with platform 10. Opening 72 is bounded by a perimeter wall 76 that is designed to receive plug 74 in proper alignment. Perimeter wall 76 in conjunction with platform 10 form a structure which is analogous to an RJ socket or receptacle. Perimeter wall 76 includes opposing sidewalls 78 each having a longitudinal first groove 80 configured to receive a corresponding alignment ridge 44 on base 12 and a longitudinal second groove 82 configured to receive a corresponding alignment ridge 46.

The inserting of alignment ridges 44 and 46 within corresponding grooves 80 and 82 facilitate proper positioning of RJ coupler 10 relative to housing 66 and helps to securely hold platform 10 between opposing sidewalls 78. Inwardly projecting from the top end of each sidewall 78 are opposing first ridges 84. Each first ridge 84 extends back to retention wall 30. Inwardly projecting above each first ridge 84 is a corresponding second ridge 88. Each second ridge 88 terminates at an end face 90 positioned only part way back toward retention wall 30. Extending between and above each second ridge 88 is a ceiling 92. First ridges 84, second ridges 88, and ceiling 92 combine to from a roof 91 extending between sidewalls 78.

As depicted in FIGS. 4 and 5, plug 74 comprises a contact block 94 housing a plurality of discrete metal contacts 96. A cable 98 is attached to contact block 94 and includes a plurality of discrete wires 100. Each wire 100 is connected to a corresponding contact 96. Contact block 94 includes a top surface 102, a bottom surface 104, and a front face 106. A plurality of sloped access slots 108 extend between front 106 and bottom surface 104 so as to openly expose a portion of each contact 96.

Projecting above contact block 94 is a flexible biased retention arm 110. Arm 110 includes a distal end 112 attached to contact block 94 and an opposing free proximal end 114. Radially projecting out from each side of arm 110 at distal end 112 are locking ramps 116. Each locking ramp 116 terminates at a face 118 projecting towards proximal end 114.

During use, plug 74 is selectively slid within opening 72 such that each contact wire 50 is received within a corresponding access slot 108 so as to bias against a discrete contact 96. This advancement of plug 74 causes each contact 96 to push down against engagement portion 56 of a corresponding conducting wire 50 so as to produce a continuous contact therebetween.

As plug 74 is inserted in to opening 72, retention arm 110 is initially pressed towards contact block 94 as locking ramps 116 pass under second ridges 88. After ramps 116 pass over second ridge 88, retention arm 110 extends up to selectively lock within opening 72. Face 118 of locking arm 1 10 is biased against end face 90 of second ridge 88. Removal of plug 74 is facilitated by merely depressing proximal end 114 of arm 110 and pulling plug 74 from opening 72.

The present invention also includes means for mechanically, releasably securing plug 74 within opening 72 in housing 66. By way of example and not by limitation, the means include second ridges 88 each having an end face 90 that locks against arm 110 as discussed above.

It will be appreciated that by obviating the need for a complete receptacle structure, some space savings may be enjoyed. The need for structures corresponding to side walls has been removed thereby allowing a smaller footprint. Likewise, the need for a roof on the receptacle itself has been eliminated thereby allowing for a thinner card. The only remaining vertical structure, the retention wall, does not need to project upwardly from the base a distance greater than necessary to halt the forward progress of the plug. The retention wall may also be narrower than depicted to allow other components to take the space. Similarly, it will be appreciated that the retention wall may actually be replaced with a similar structure belonging to another component on the PC board. Such integration of function is in keeping with the spirit of this invention.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. In an electrical device having a housing with an opening formed therein that is adapted to physically receive a modular plug, a connector block facilitates electrical connection between the electrical device and the received plug, the connector block comprising:

(a) a substantially sideless base having a bottom surface, a top surface, a first end and a second end, one of said ends of said base being adapted to be positioned proximate the opening in the housing of the electrical device, at least a portion of said bottom surface of said base being adapted to be mounted on a printed circuit board at least partially disposed within the housing;

(b) an upwardly extending portion attached to said base, said upwardly extending portion having a front surface, a rear surface and a top surface; and (c) one or more conducting wires, each conducting wire of said one or more conducting wires having a first end adapted to be electrically connected directly to an electrical contact on the printed circuit board, each conducting wire having a second end adapted to be electrically connected directly to a contact on modular plug received within the opening in the housing, the conducting wires being adapted to facilitate electrical connection between the plug and the printed circuit board.

2. The connector block of claim 1, wherein said upwardly extending portion is adapted to stop the modular plug once the plug has been received a predetermined distance within the opening in the housing of the electrical device.

3. The connector block of claim 1, further comprising a plurality of generally aligned slots in said upwardly extending portion, wherein a portion of each of said one or more conducting wires is disposed within one of said plurality of generally aligned slots.

4. The connector block of claim 1, wherein the base is adapted to be generally aligned with the opening in the housing, and the opening in the housing is adapted to provide the physical and structural support to releasably connect the modular plug to the housing.

5. The connector block of claim 1, wherein said first end of each of said conducting wires is positioned generally parallel to an upper surface of the printed circuit board.

6. The connector block of claim 1, further comprising one or more alignment pins extending downwardly from said base, said alignment pins being sized and configured to be connected to corresponding receiving portions in the printed circuit board located within the housing of the electrical device.

7. The connector block of claim 1, wherein at least a portion of said bottom surface of said base is positioned generally parallel to an upper surface of the printed circuit board.

8. The connector block of claim 1, wherein said upwardly extending portion and said base are a unitary, one-piece structure.

9. The connector block of claim 1, wherein an outer surface of the connector block is adapted to abut the printed circuit board disposed within the housing of the electrical device.

10. The connector block of claim 1, wherein said top surface of said upwardly extending portion is adapted to be located proximate an interior surface of the housing of the electrical device.

11. The connector block of claim 1, wherein one of said ends of said base is adapted to be generally aligned with an edge of the printed circuit board disposed within the housing of the electrical device.

12. The connector block of claim 1, wherein the base is adapted to be generally aligned with the opening in the housing of the electrical device, and the opening is configured to stop the modular plug once the plug has been received a predetermined distance within the housing.

13. An electrical connector that facilitates electrical communication with a modular plug, the electrical connector comprising:

(a) a housing including a cut-out section which defines at least a portion of an opening, said opening being sized and shaped to physically receive the modular plug in a manner so that at least a portion of the modular plug is exposed within an interior portion of said housing;

(b) a printed circuit board at least partially disposed within said interior portion of said housing, said printed circuit board including an upper surface and a lower surface, said printed circuit board including a plurality of electrical contacts formed on said upper surface;

(c) a connector block at least partially disposed within said interior portion of said housing, said connector block including;

i. a substantially sideless base with a top surface and a bottom surface, at least a portion of said bottom surface of said base being positioned generally parallel to said upper surface of said printed circuit board, at least a portion of said bottom surface of said base being mounted on said printed circuit board; and ii. an upwardly extending portion connected to said base; and (d) a plurality of wires connected to said printed circuit board, said wires being capable of conveying electrical signals between said electrical contacts on said printed circuit board and corresponding contacts positioned on said modular plug when the plus is received within said opening in said housing.

14. An electrical connector that facilitates electrical communication with a modular plug, the electrical connector comprising:

(a) a housing including a cut-out section which defines at least a portion of an opening, said opening being sized and shaped to physically receive the modular plug in a manner so that at least a portion of the modular plug is exposed within an interior portion of said housing;

(b) sprinted circuit board at least partially disposed within said interior portion of said housing, said printed circuit board including an upper surface and a lower surface, said printed circuit board including a plurality of electrical contacts formed on said upper surface;

(c) a connector block at least partially disposed within said interior portion of said housing, said connector block including:

i. a base with a top surface and a bottom surface, at least a portion of said bottom surface of said base being positioned generally parallel to said upper surface of said printed circuit board; and ii. an upwardly extending portion connected to said base; and (d) a plurality of wires connected to said printed circuit board, said wires being capable of conveying electrical signals between said electrical contacts on said printed circuit board and corresponding contacts positioned on said modular plug when the plug is received within said opening in said housing.

15. The electrical connector of claim 14, further comprising at least one alignment pin protruding from said connector block, said alignment pin being sized and configured to be connected to a corresponding receiving portion in said printed circuit board.

16. The electrical connector of claim 14, wherein an edge of said printed circuit board is generally aligned with an end of said base.

17. The electrical connector of claim 14, wherein said upwardly extending portion is adapted to abut against an end of the plug when the plug has been received within said opening a predetermined distance.

18. The electrical connector of claim 14, wherein each wire from said plurality of wires includes a first end and a second end, said first end being electrically connected directly to one of said electrical contacts on said printed circuit board and said second end being adapted to be electrically connected directly to a contact on the modular plug received within the opening in said housing.

19. The electrical connector of claim 14, wherein said opening in said housing is partially defined by a first portion which is configured to receive a resilient clip of the modular plug.

20. The electrical connector of claim 14, wherein said connector block is positioned proximate to said opening in said housing, and wherein said connector block is generally aligned with at least a portion of said opening in said housing.

21. An electrical apparatus operable with a communication plug, the apparatus comprising:

(a) a housing including a cut-out section which defines at least a portion of an opening, said opening being sized and shaped so as to be capable of receiving the communication plug; and (b) a connector block enclosed within said housing, said connector block including:

i. a substantially sideless base having a first end, a second end, a top surface and a bottom surface, at least a portion of said bottom surface of said base being mounted on a printed circuit board which is at least partially disposed within said housing;

ii. a generally upwardly extending portion attached to said base; and iii. a plurality of conducting wires, each of said conducting wires having a first end that is directly connectable to a corresponding electrical contact on a top surface of the printed circuit board and a second end that is configured to be electrically coupled to a contact on the communication plug.

22. The electrical apparatus of claim 21, wherein said opening in said housing is partially defined by a first portion that is configured to receive a resilient clip of the communication plug.

23. The electrical apparatus of claim 21, wherein said connector block is positioned proximate to said opening in said housing, and wherein said connector block is generally aligned with at least a portion of said opening to facilitate insertion of the communication plug into said opening and engagement of a portion of the plug with a portion of the connector block.

24. The electrical apparatus of claim 21, further comprising at least one alignment pin protruding from said connector block, said alignment pin being sized and configured to be connected to a corresponding receiving portion in the printed circuit board.

25. An electrical apparatus operable with a communication plug, said apparatus comprising:

(a) a housing including an opening which is sized and shaped to receive the communication plug;

(b) a printed circuit board including a plurality of electrical contacts, said printed circuit board at least partially disposed within said housing;

(c) a connector block at least partially disposed within said housing, said connector block including:

i. a substantially sideless base having a first end, a second end, a top surface and a bottom surface, said base being positioned proximate to an edge of said printed circuit board, at least a portion of said base being mounted on said printed circuit board; and ii. an upwardly extending section attached to said base;

(d) at least one conducting wire having a first end and a second end, said conducting wire being capable of directly electrically connecting said printed circuit board to the communication plug received within said opening of said housing; and (e) one or more alignment pins attached to said connector block, said alignment pins being sized and configured to be connected to corresponding receiving portions in said printed circuit board.

26. The electrical apparatus of claim 25, wherein said first end of said conducting wire is positioned generally parallel to a top surface of said printed circuit board and at least a portion of said second end of said conducting wire is disposed within said opening in said housing, and wherein said first end of said conducting wire is connected to one of said electrical contacts on said printed circuit board.

27. The electrical apparatus of claim 25, wherein said connector block is positioned proximate to said opening in said housing, and wherein said connector block is generally aligned with at least a portion of said opening to facilitate insertion of the communication plug into said opening and engagement of a portion of the plug with a portion of the connector block.

28. An electrical apparatus that facilitates electrical communication with a modular plug, said apparatus comprising:

a housing including an opening which is sized and shaped to receive the modular plug;

a printed circuit board including a plurality of electrical contacts, said printed circuit board at least partially disposed within said housing;

a connector block at least partially disposed within said housing, said connector block including a substantially sideless base having a top surface and a bottom surface, said connector block including an upwardly extending section attached to said base, at least a portion of the connector block mounted on the printed circuit board said connector block being positioned proximate said opening in said housing and said connector block being generally aligned with at least a portion of said opening to facilitate insertion of the modular plug into said opening and engagement of a portion of the plug with a portion of the connector block; and at least one conducting wire having a first end and a second end, said conducting wire being capable of directly electrically connecting said printed circuit board to the modular plug received within said opening of said housing.

29. A device that facilitates electrical communication with a standard RJ-type connector plug, said device comprising:

a housing including a top surface, a bottom surface, a first sidewall, a second sidewall, a front portion and a rear portion;

a printed circuit board enclosed within said housing, the printed circuit board including a front end, a rear end and a plurality of electrical contacts, the rear end of the printed circuit board being disposed within the rear portion of the housing;

a connector block mounted on the rear end of the printed circuit board, said connector block including a substantially sideless base with an upwardly extending section attached to said base, said upwardly extending section having an overall height within the thickness, confines of the rear portion of the housing, said connector block including a plurality of conducting wires, each conducting wire of said plurality of conducting wires including a first end and a second end, said plurality of conducting wires being capable of directly electrically connecting said printed circuit board to the standard RJ-type connector plug; and at least one receptacle defined by the rear portion of said housing, the at least one receptacle being sized and configured to receive the standard RJ-type connector plug, each receptacle including a plurality or inner surfaces, at least one of said plurality of inner surfaces being adapted to abut an outer surface of the RJ-type connector plug.

30. A method of making a connector block, the connector block being adapted to be disposed within an electrical device including a housing with an opening formed therein that is adapted to physically receive a modular pug, the connector block facilitating electrical communication between the electrical device and the received plug, the method comprising:

(a) providing a substantially sideless base having a bottom surface, a top surface, a first end and a second end, one of said ends of said base being adapted to be positioned proximate the opening in the housing of the electrical device, at least a portion of said bottom surface of said base being adapted to be mounted on a printed circuit board at least partially disposed within the housing;

(b) attaching an upwardly extending portion to said base, said upwardly extending portion having a front surface, a rear surface and a top surface; and (e) providing one or more conducting wires, each conducting wire of said one or more conducting wires having a first end adapted to be electrically connected directly to an electrical contact on the printed circuit board that is at least partially disposed within the housing, each conducting wire having a second end adapted to be electrically connected directly to a contact on the modular plug received within the opening in the housing, the conducting wires being adapted to facilitate electrical connection between the plug and the printed circuit board.

31. The method of claim 30, wherein said upwardly extending portion is adapted to stop the modular plug once the plug has been received a predetermined distance within the opening in the housing of the electrical device.

32. The method of claim 30, further comprising providing a plurality of generally aligned slots in said upwardly extending portion, wherein a portion of each of said one or more conducting wires is disposed within one of said plurality of generally aligned slots.

33. The method of claim 30, wherein the base is adapted to be generally aligned with the opening in the housing, and the opening in the housing is adapted to provide the physical and structural support to releasably connect the modular plug to the housing.

34. The method of claim 30, wherein said first end of each of said conducting wires is positioned generally parallel to an upper surface of the printed circuit board.

35. The method of claim 30, further comprising providing one or more alignment pins that extend downwardly from said base, said alignment pins being sized and configured to be connected to corresponding receiving portions in the printed circuit board located within the housing of the electrical device.

36. The method of claim 30, wherein at least a portion of said bottom surface of said base is positioned generally parallel to an upper surface of the printed circuit board.

37. The method of claim 30, wherein said upwardly extending portion and said base are a unitary, one-piece structure.

38. The method of claim 30, wherein an outer surface of the connector block is adapted to abut the printed circuit board disposed within the housing of the electrical device.

39. The method of claim 30, wherein said top surface of said upwardly extending portion is adapted to be located proximate an interior surface of the housing of the electrical device.

40. The method of claim 30, wherein one of said ends of said base is adapted to be generally aligned with an edge of the (a) printed circuit board disposed within the housing of the electrical device.

41. The method of claim 30, wherein the base is adapted to be generally aligned with the opening in the housing of the electrical device, and the opening is configured to stop the modular plug once the plug has been received a predetermined distance within the housing.

42. A method of making an electrical connector that facilitates electrical communication with a modular plug, the method comprising:

(a) providing a housing with a cut-out section that defines at least a portion of an opening, said opening being sized and shaped to physically receive the modular plug; in a manner so that at least a portion of the modular plug is exposed within an interior portion of said housing;

(b) disposing a printed circuit board at least partially within said interior portion of said housing, said printed circuit board including an upper surface and a lower surface, said printed circuit board including a plurality of electrical contacts formed on said upper surface;

(c) disposing a connector block at least partially within said interior portion of said housing, said connector block including i. a substantially sideless base with a top surface and a bottom surface, at least a portion of said bottom surface of said base being positioned generally parallel to said upper surface of said printed circuit board, at least a portion of said bottom surface of said base being mounted on said printed circuit board; and ii. an upwardly extending portion connected to said base; and (d) connecting a plurality of wires to said printed circuit board, said wires being capable of conveying electrical signals between said electrical contacts on said printed circuit board and corresponding contacts positioned on said modular plug when the plug is received within said opening in said housing.

43. A method of making an electrical connector that facilitates electrical communication with a modular plug, the method comprising:

(a) providing a housing with a cut-out section that defines at least a portion of an opening, said opening being sized and shaped to physically receive the modular plug in a manner so that at least a portion of the modular plug is exposed within all interior portion of said housing;

(b) disposing a printed circuit board at least partially within said interior portion of said housing, said printed circuit board including an upper surface and a lower surface, said printed circuit board including a plurality of electrical contacts formed on said upper surface;

(c) disposing a connector block at least partially within said interior portion of said housing, said connector block including:

i. a base with a top surface and a bottom surface, at least a portion of said bottom surface of said base being positioned generally parallel to said upper surface of said printed circuit board; and ii. an upwardly extending portion connected to said base; and (d) connecting a plurality of wires to said printed circuit board, said wires being capable of conveying electrical signals between said electrical contacts on said printed circuit board and corresponding contacts positioned on said modular plug when the plug is received within said opening in said housing.

44. The method of claim 43, further comprising providing at least one alignment pin that protrudes from said connector block, said alignment pin being sized and configured to be connected to a corresponding receiving portion in said printed circuit board.

45. The method of claim 43, wherein an edge of said printed circuit board is generally aligned with an end of said base.

46. The method of claim 43, wherein said upwardly extending portion is adapted to abut against an end of the plug when the plug has been received within said opening a predetermined distance.

47. The method of claim 43, wherein each wire front said plurality of wires includes a first end and a second end, said first end being electrically connected directly to one of said electrical contacts on said printed circuit board and said second end being adapted to be electrically connected directly to a contact on the modular plug received within the opening in said housing.

48. The method of claim 43, wherein said opening in said housing is partially defined by a first portion which is configured to receive a resilient clip of the modular plug.

49. The method of claim 43, wherein said connector block is positioned proximate to said opening in said housing, and wherein said connector block is generally aligned with at least a portion of said opening in said housing.

50. A method of making an electrical apparatus that is operable with a communication plug, the method comprising:

(a) providing a housing with a cut-out section that defines at least a portion of an opening, said opening being sized and shaped so as to be capable of receiving the communication plug; and (b) enclosing a connector block within said housing, said connector block including:

i. a substantially sideless base having a first end, a second end, a top surface, and a bottom surface, at least a portion of said bottom surface of said base being mounted on a printed circuit board which is at least partially disposed within said housing;

ii. a generally upwardly extending portion attached to said base; and iii. a plurality of conducting wires, each of said conducting wires having a first end that is directly connectable to a corresponding electrical contact on a top surface of the printed circuit board and a second end that is configured to be electrically coupled to a contact on the communication plug.

51. The method of claim 50, wherein said opening in said housing is partially defined by a first portion that is configured to receive a resilient clip of the communication plug.

52. The method of claim 50, wherein said connector block is positioned proximate to said opening in said housing, and wherein said connector block is generally aligned with at least a portion of said opening to facilitate insertion of the communication plug into said opening and engagement of a portion of the plug with a portion of the connector block.

53. The method of claim 50, further comprising providing at least one alignment pin that protrudes from said connector block, said alignment pin being sized and configured to be connected to a corresponding receiving portion in the printed circuit board.

54. A method of making art electrical apparatus that is operable with a communication plug, the method comprising:

(a) providing a housing with an opening that is sized and shaped to receive the communication plug;

(b) providing a printed circuit board with a plurality of electrical contacts, said printed circuit board at least partially disposed within said housing;

(c) disposing a connector block at least partially within said housing, said connector block including:

i. a substantially sideless base having a first end, a second end, a top surface and a bottom surface, said base being positioned proximate to an edge of said printed circuit board at least a portion of said base being mounted on said printed circuit board; and ii. an upwardly extending section attached to said base;

(d) providing at least one conducting wire with a first end and a second end, said conducting wire being capable of directly electrically connecting said printed circuit board to the communication plug received within said opening of said housing; and (e) attaching one or more alignment pins to said connector block, said alignment pins being sized and configured to be connected to corresponding receiving portions in said printed circuit board.

55. The method of claim 54, wherein said first end of said conducting wire is positioned generally parallel to a top surface of said printed circuit board and at least a portion of said second end of said conducting wire is disposed within said opening in said housing, and wherein said first end of said conducting wire is connected to one of said electrical contacts on said printed circuit board.

56. The method of claim 54, wherein said connector block is positioned proximate to said opening in said housing, and wherein said connector block is generally aligned with at least a portion of said opening to facilitate insertion of the communication plug into said opening and engagement of a portion of the plug with a portion of the connector block.

57. A method of making an electrical apparatus that facilitates electrical communication with a modular plug, the method comprising:

providing a housing with an opening that is sized and shaped to receive the modular plug;

providing a printed circuit board with a plurality of electrical contacts, said printed circuit board at least partially disposed within said housing;

disposing a connector block at least partially within said housing, said connector block including a substantially sideless base having a top surface and a bottom surface, said connector block including an upwardly extending section attached to said base, at least a portion of the connector block mounted on the printed circuit board, said connector block being positioned proximate said opening in said housing and said connector block being generally aligned with at least a portion of said opening to facilitate insertion of the modular plug into said opening and engagement of a portion of the plug with a portion of the connector block;

and providing at least one conducting wire with a first end and a second end, said conducting wire being capable of directly electrically connecting said printed circuit board to the modular plug received within said opening of said housing.

58. A method of making a device that facilitates electrical communication with a standard RJ-type connector plug, said method comprising:

providing a housing including a top surface, a bottom surface, a first sidewall, a second sidewall, a front portion and a rear portion; enclosing a printed circuit board within said housing, the printed circuit board including a front end, a rear end and a plurality of electrical contacts, the rear end of the printed circuit board being disposed within the rear portion of the housing;

mounting a connector block on the rear end of the printed circuit board, said connector block including a substantially sideless base with an upwardly extending section attached to said base, said upwardly extending section having an overall height within the thickness confines of the rear portion of the housing, said connector block including a plurality of conducting wires, each conducting wire of said plurality of conducting wires including a first end and a second end, said plurality of conducting wires being capable of directly electrically connecting said printed circuit board to the standard RJ-type connector plug; and defining at least one receptacle by the rear portion of said housing, the at least one receptacle being sized and configured to receive the standard RJ-type connector plug, each receptacle including a plurality of inner surfaces, at least one of said plurality of inner surfaces being adapted to abut an outer surface of the RJ-type connector slug.

* * * * *